US009074545B2

(12) United States Patent
Kato et al.

(10) Patent No.: US 9,074,545 B2
(45) Date of Patent: Jul. 7, 2015

(54) AIR-FUEL RATIO IMBALANCE DETECTING DEVICE AND AIR-FUEL RATIO IMBALANCE DETECTING METHOD FOR INTERNAL COMBUSTION ENGINE

(71) Applicants: Toshikazu Kato, Toyota (JP); Yusuke Fujitsu, Anjo (JP)

(72) Inventors: Toshikazu Kato, Toyota (JP); Yusuke Fujitsu, Anjo (JP)

(73) Assignees: TOYOTA JIDOSHA KABUSHIKI KAISHA, Toyota-shi (JP); DENSO CORPORATION, Kariya-shi (JP)

( * ) Notice: Subject to any disclaimer, the term of this patent is extended or adjusted under 35 U.S.C. 154(b) by 200 days.

(21) Appl. No.: 13/755,769

(22) Filed: Jan. 31, 2013

(65) Prior Publication Data

US 2013/0197783 A1 Aug. 1, 2013

(30) Foreign Application Priority Data

Feb. 1, 2012 (JP) ..... 2012-019933

(51) Int. Cl.

| | |
|---|---|
| ***F02D 41/02*** | (2006.01) |
| ***F02D 41/22*** | (2006.01) |
| ***F02D 41/00*** | (2006.01) |
| *F02D 41/14* | (2006.01) |
| *F02D 41/28* | (2006.01) |

(52) U.S. Cl.

CPC ..... *F02D 41/1495* (2013.01); *F02D 41/1454* (2013.01); *F02D 41/222* (2013.01); *F02D 41/0085* (2013.01); *F02D 41/008* (2013.01); *F02D 41/1456* (2013.01); *F02D 2041/286* (2013.01)

(58) Field of Classification Search

CPC ..... F02D 41/0085; F02D 41/1554; F02D 41/222; F02D 41/1495; F02D 41/02

USPC ..... 701/101, 102, 103, 109; 123/692, 679, 123/681, 436, 687, 690

See application file for complete search history.

(56) References Cited

U.S. PATENT DOCUMENTS

| | | | | |
|---|---|---|---|---|
| 6,668,812 | B2 * | 12/2003 | Javaherian | 123/673 |
| 2011/0174282 | A1 * | 7/2011 | Maruyama et al. | 123/703 |
| 2012/0173115 | A1 | 7/2012 | Sawada et al. | |

FOREIGN PATENT DOCUMENTS

| | | | | |
|---|---|---|---|---|
| JP | 2004011435 | A | * | 1/2004 |
| JP | 2011-144785 | | | 7/2011 |
| JP | 2011-252412 | A | | 12/2011 |
| JP | 2012-017657 | A | | 1/2012 |
| JP | 2013221483 | A | * | 10/2013 |
| WO | WO 2011/001539 | A1 | | 1/2011 |
| WO | 2011/074132 | A1 | | 6/2011 |

* cited by examiner

*Primary Examiner* — Mahmoud Gimie

(74) *Attorney, Agent, or Firm* — Oblon, McClelland, Maier & Neustadt, L.L.P.

(57) ABSTRACT

An air-fuel ratio imbalance detecting device for an internal combustion engine, which detects a rich imbalance in air-fuel ratio among a plurality of cylinders on the basis of a variation per unit time in air-fuel ratio that is detected by an air-fuel ratio sensor provided in an exhaust passage of the internal combustion engine, includes an electronic control unit that normalizes the variation per unit time in air-fuel ratio with a constant associated with a rotation speed and load factor of the internal combustion engine and that, when the normalized value is smaller than a predetermined threshold, determines that a rich imbalance in air-fuel ratio has been detected among the cylinders.

6 Claims, 7 Drawing Sheets

AIR-FUEL RATIO IMBALANCE DETECTING DEVICE AND AIR-FUEL RATIO IMBALANCE DETECTING METHOD FOR INTERNAL COMBUSTION ENGINE

INCORPORATION BY REFERENCE

The disclosure of Japanese Patent Application No. 2012-019933 filed on Feb. 1, 2012 including the specification, drawings and abstract is incorporated herein by reference in its entirety.

BACKGROUND OF THE INVENTION

1. Field of the Invention

The invention relates to an air-fuel ratio imbalance detecting device and air-fuel ratio imbalance detecting method for an internal combustion engine.

2. Description of Related Art

There is a device in which, in a state where an operating state of an internal combustion engine is a predetermined steady operation state, when a variation per unit time in air-fuel ratio detected by an air-fuel ratio sensor provided in an exhaust pipe falls outside a predetermined range, it is determined that there is an imbalance in air-fuel ratio among cylinders of the internal combustion engine (for example, see Japanese Patent Application Publication No. 2011-144785 (JP 2011-144785 A)). In this way, the device described in JP 2011-144785 A simply determines whether there is an imbalance in air-fuel ratio among the cylinders of the internal combustion engine.

In the above-described air-fuel ratio imbalance detecting device for an internal combustion engine, it is possible to detect an imbalance in air-fuel ratio among the cylinders of the internal combustion engine by normalizing a variation per unit time in the air-fuel ratio of the internal combustion engine with a constant based on an intake air amount and then comparing the normalized variation per unit time in the air-fuel ratio with a predetermined threshold.

However, a normalized value obtained by normalizing a variation per unit time in the air-fuel ratio of the internal combustion engine with a constant based on an intake air amount does not incorporate a difference in load factor at the same intake air amount, so a difference between a normalized value in the case where there is an imbalance in air-fuel ratio among the cylinders of the internal combustion engine and a normalized value in the case where there is no imbalance may be small due to a difference in load factor.

Thus, the above-described air-fuel ratio imbalance detecting device for an internal combustion engine may not be able to detect an imbalance in air-fuel ratio among the cylinders of the internal combustion engine or may erroneously detect an imbalance.

SUMMARY OF THE INVENTION

The invention provides an air-fuel ratio imbalance detecting device and air-fuel ratio imbalance detecting method for an internal combustion engine, which are able to accurately detect an imbalance in air-fuel ratio among cylinders of the internal combustion engine.

An aspect of the invention provides an air-fuel ratio imbalance detecting device for an internal combustion engine. The air-fuel ratio imbalance detecting device, which detects a rich imbalance in air-fuel ratio among a plurality of cylinders on the basis of a variation per unit time in air-fuel ratio that is detected by an air-fuel ratio sensor provided in an exhaust passage of the internal combustion engine, includes an electronic control unit that normalizes the variation per unit time in air-fuel ratio with a constant associated with a rotation speed and load factor of the internal combustion engine and that, when the normalized value is smaller than a predetermined threshold, determines that a rich imbalance in air-fuel ratio has been detected among the cylinders.

With this configuration, the air-fuel ratio imbalance detecting device for an internal combustion engine according to the aspect of the invention detects a rich imbalance in air-fuel ratio among the cylinders on the basis of the normalized value that incorporates a difference in load factor at the same intake air amount by normalizing the variation per unit time in air-fuel ratio with the constant associated with the rotation speed and load factor of the internal combustion engine, so it is possible to accurately detect an imbalance in air-fuel ratio among the cylinders of the internal combustion engine.

In the air-fuel ratio imbalance detecting device, the electronic control unit may normalize a minimum value of the variation per unit time in air-fuel ratio while the internal combustion engine operates one cycle.

With this configuration, the air-fuel ratio imbalance detecting device for an internal combustion engine according to the aspect of the invention is able to reduce a normalized value when there is an imbalance in air-fuel ratio among the cylinders of the internal combustion engine, so it is possible to increase a difference between a normalized value when there is an imbalance in air-fuel ratio among the cylinders of the internal combustion engine and a normalized value when there is no imbalance.

In the air-fuel ratio imbalance detecting device, the electronic control unit may obtain the normalized value by averaging a predetermined number of the normalized minimum values.

With this configuration, the air-fuel ratio imbalance detecting device for an internal combustion engine according to the aspect of the invention is able to prevent detection of an imbalance in the air-fuel ratio among the cylinders due to another factor, such as a disturbance, other than an operation abnormality of the internal combustion engine.

Another aspect of the invention provides an air-fuel ratio imbalance detecting method for an internal combustion engine. The air-fuel ratio imbalance detecting method, which detects a rich imbalance in air-fuel ratio among a plurality of cylinders on the basis of a variation per unit time in air-fuel ratio that is detected by an air-fuel ratio sensor provided in an exhaust passage of the internal combustion engine, includes: normalizing the variation per unit time in air-fuel ratio with a constant associated with a rotation speed and load factor of the internal combustion engine; and, when the normalized value is smaller than a predetermined threshold, determining that a rich imbalance in air-fuel ratio has been detected among the cylinders.

In the air-fuel ratio imbalance detecting method, a minimum value of the variation per unit time in air-fuel ratio may be normalized while the internal combustion engine operates one cycle.

In the air-fuel ratio imbalance detecting method, the normalized value may be obtained by averaging a predetermined number of the normalized minimum values.

According to the aspects of the invention, it is possible to provide an air-fuel ratio imbalance detecting device and air-fuel ratio imbalance detecting method for an internal combustion engine, which are able to accurately detect an imbalance in air-fuel ratio among cylinders of the internal combustion engine.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, an embodiment of the invention will be described with reference to the accompanying drawings. The following description will be made on an example in which an air-fuel ratio imbalance detecting device for an internal combustion engine according to the invention is applied to a power split-type hybrid vehicle.

Figure 1:
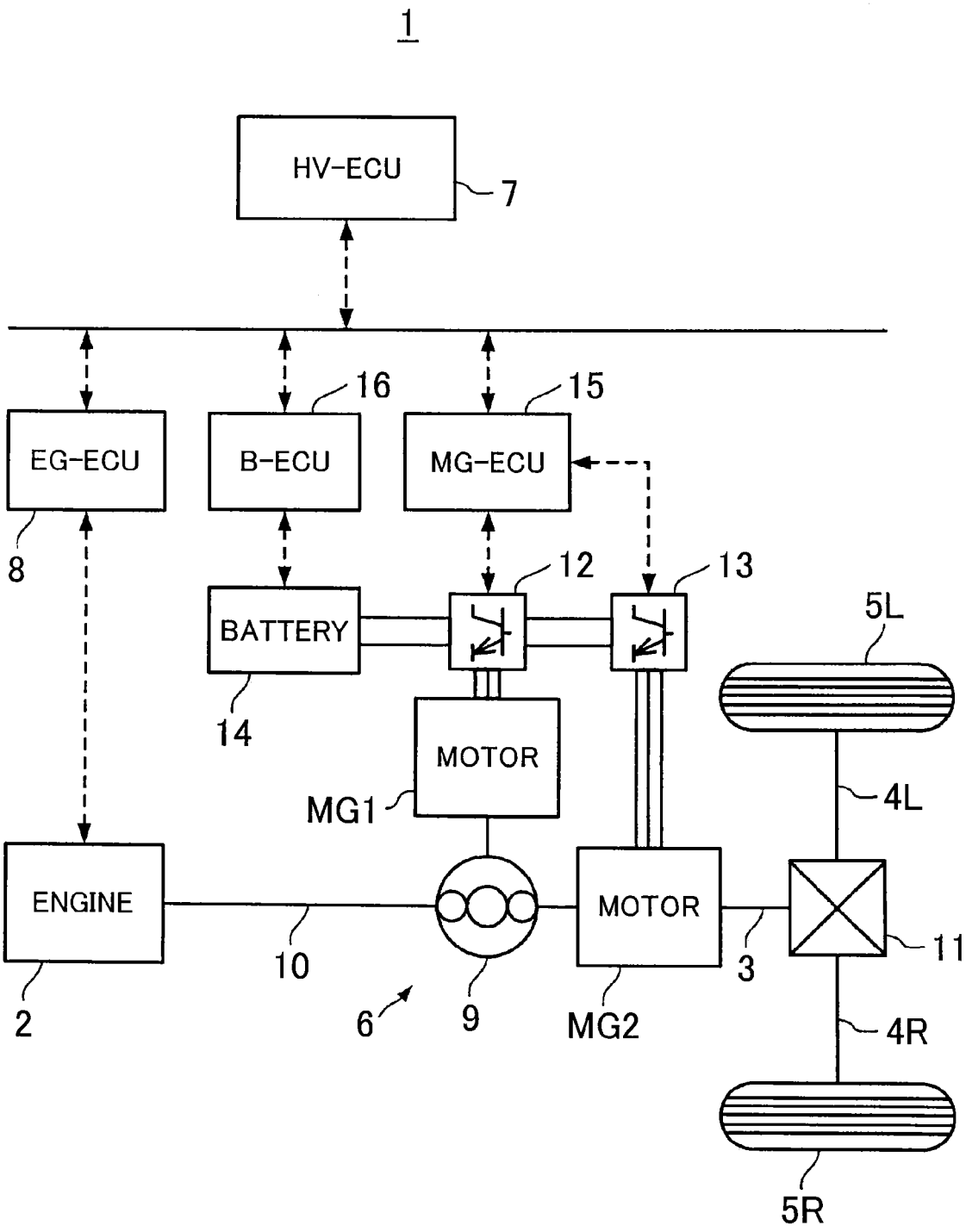
FIG. 1 is a functional block diagram that shows the configuration of a vehicle to which an air-fuel ratio imbalance detecting device for an internal combustion engine according to an embodiment of the invention is applied.

As shown in FIG. 1, the hybrid vehicle 1 includes an engine 2, a power transmission device 6, a hybrid electronic control unit (hereinafter, referred to as "HV-ECU") 7, and an engine electronic control unit (hereinafter, referred to as "EG-ECU") 8. The engine 2 constitutes an internal combustion engine. The power transmission device 6 is used to transmit power, generated by the engine 2, to drive wheels 5R and 5L via a driving shaft 3 and drive shafts 4R and 4L. The HV-ECU 7 controls various portions of the hybrid vehicle 1. The EG-ECU 8 controls the engine 2.

In the present embodiment, the engine 2 is formed of an in-line four-cylinder engine that uses gasoline as fuel. According to the invention, the engine 2 may be formed of various types of engine, such as an in-line six-cylinder engine, a V-six engine, a V-twelve engine and a horizontally opposed six-cylinder engine.

Fuel that is used in the engine 2 may be a hydrocarbon-based fuel, such as light oil, instead of gasoline or may be alcohol fuel that mixedly contains alcohol, such as ethanol, and gasoline.

Figure 2:
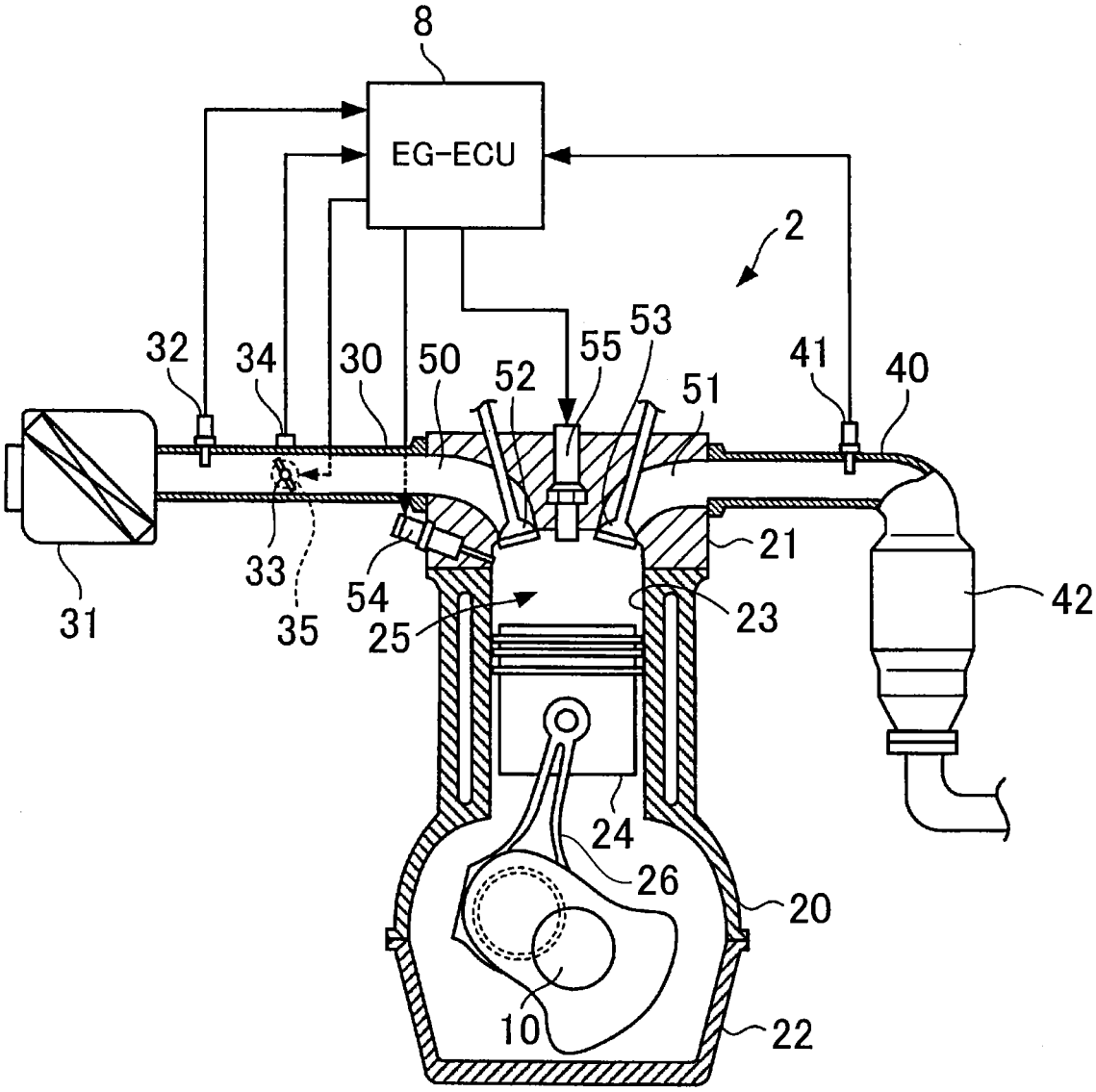
FIG. 2 is a schematic cross-sectional view of the engine shown in FIG. 1.

As shown in FIG. 2, the engine 2 includes a cylinder block 20, a cylinder head 21 fixed to the upper portion of the cylinder block 20, and an oil pan 22 that stores oil, and a plurality of cylinders 23 are formed by the cylinder block 20 and the cylinder head 21. In the engine 2 shown in FIG. 2, one of the four cylinders 23 arranged in line is illustrated.

A piston 24 is accommodated in each cylinder 23 so as to be reciprocally movable. A combustion chamber 25 of each cylinder 23 is defined by the cylinder block 20, the cylinder head 21 and the corresponding piston 24. The engine 2 carries out a series of four strokes, that is, an intake stroke, a compression stroke, a combustion stroke and an exhaust stroke, while each piston 24 reciprocates twice.

Each piston 24 accommodated in the corresponding cylinder 23 is coupled to a crankshaft 10 via a corresponding connecting rod 26. The connecting rod 26 converts the reciprocating motion of the piston 24 to the rotation motion of the crankshaft 10.

Thus, the engine 2 reciprocally moves each piston 24 by combusting a mixture of fuel and air in the corresponding combustion chamber 25, and transmits power to the power transmission device 6 by rotating the crankshaft 10 via the corresponding connecting rod 26.

The engine 2 is provided with an intake pipe 30 that is coupled to the cylinder head 21 in order to introduce air into the combustion chambers 25. An air cleaner 31, an air flow sensor 32, a throttle valve 33 and a throttle sensor 34 are provided in the intake pipe 30. The air cleaner 31 cleans air flowing in from an outside of the vehicle. The air flow sensor 32 detects the flow rate of air that is introduced into the combustion chambers 25, that is, an intake air amount. The throttle valve 33 is used to adjust the intake air amount. The throttle sensor 34 detects the opening degree of the throttle valve 33.

The air cleaner 31, for example, removes foreign matter in intake air with the use of a paper accommodated inside or a nonwoven filter made of synthetic fiber. The air flow sensor 32 is provided upstream of the throttle valve 33, and outputs a detection signal indicating an intake air amount to the EG-ECU 8.

The throttle valve 33 is formed of a thin disc-shaped valve element, and includes a shaft at the center of the valve element. The throttle valve 33 includes a throttle valve actuator 35. The throttle valve actuator 35 pivots the valve element by pivoting the shaft in response to control of the EG-ECU 8, and causes the throttle valve 33 to adjust the intake air amount.

The engine 2 is provided with an exhaust pipe 40 that is coupled to the cylinder head 21 in order to emit exhaust gas, produced through combustion of air-fuel mixture in the combustion chambers 25, to the outside of the vehicle. An air-fuel ratio sensor 41 and a catalyst 42 are provided in the exhaust pipe 40. The air-fuel ratio sensor 41 detects the overall air-fuel ratio of the engine 2. The catalyst 42 is used to oxidize, reduce and purify toxic substances in exhaust gas.

The air-fuel ratio sensor 41 detects an air-fuel ratio that indicates the ratio of the amount of air to the amount of fuel in air-fuel mixture in the combustion chambers 25, and outputs a detection signal that linearly indicates the detected air-fuel ratio to the EG-ECU 8.

The catalyst 42 generally includes a three-way catalyst that is able to efficiently remove toxic substances, such as unburned hydrocarbons (HC), carbon monoxide (CO) and nitrogen oxides (NOx), contained in exhaust gas. The three-way catalyst desirably has the function of efficiently removing NOx from exhaust gas having a high NOx content.

Intake ports 50 and exhaust ports 51 are formed in the cylinder head 21. Each intake port 50 communicates the intake pipe 30 with the corresponding combustion chamber 25. Each exhaust port 51 communicates the corresponding combustion chamber 25 with the exhaust pipe 40.

Intake valves 52, exhaust valves 53, injectors 54 and ignition plugs 55 are provided at the cylinder head 21. Each intake valve 52 is used to control introduction of air for combustion from the intake pipe 30 into the corresponding combustion chamber 25. Each exhaust valve 53 is used to control discharge of exhaust gas from the corresponding combustion chamber 25 to the exhaust pipe 40. Each injector 54 is used to inject fuel into the corresponding combustion chamber 25. Each ignition plug 55 is used to ignite air-fuel mixture in the corresponding combustion chamber 25.

Each injector 54 includes a solenoid coil and a needle valve. The solenoid coil is controlled by the EG-ECU 8. Fuel is supplied to each injector 54 at a predetermined pressure. When the solenoid coil is energized by the EG-ECU 8, the injector 54 injects fuel into the corresponding combustion chamber 25 by opening the needle valve.

Each ignition plug 55 is formed of a known ignition plug having electrodes made of platinum or iridium alloy. Each ignition plug 55 discharges when the electrodes are energized by the EG-ECU 8, and ignites air-fuel mixture in the corresponding combustion chamber 25.

Figure 3:
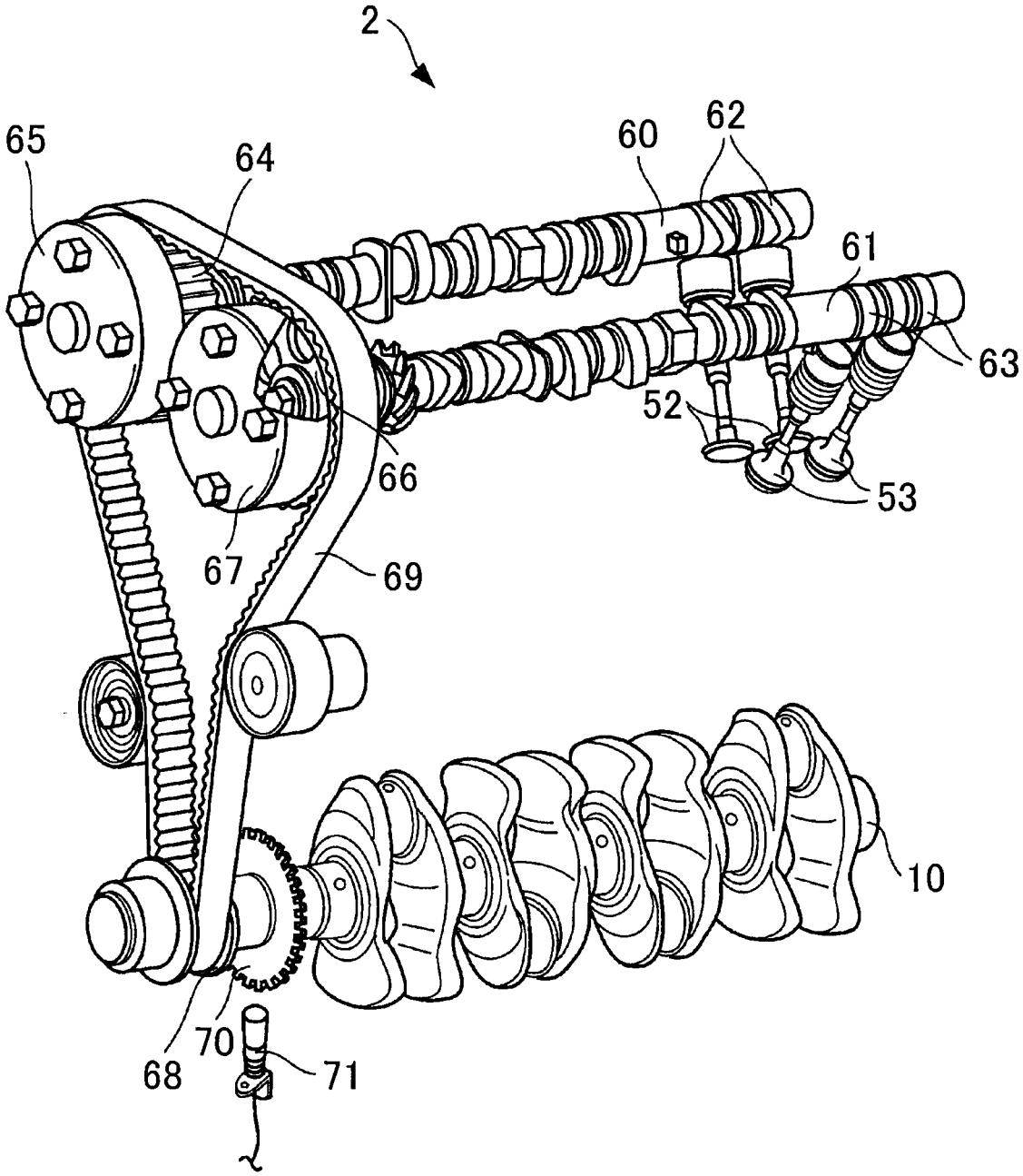
FIG. 3 is a schematic perspective view of the engine shown in FIG. 1.

As shown in FIG. 3, an intake camshaft 60 and an exhaust camshaft 61 are rotatably provided above the cylinder head 21 of the engine 2. Intake cams 62 are provided on the intake camshaft 60. The intake cams 62 contact the upper ends of the intake valves 52. As the intake camshaft 60 rotates, each set of intake cams 62 open or close the intake valves 52, and fluid communication between the intake ports 50 and the combustion chamber 25 is allowed or interrupted.

Exhaust cams 63 are provided on the exhaust camshaft 61. The exhaust cams 63 contact the upper ends of the exhaust valves 53. As the exhaust camshaft 61 rotates, each set of exhaust cams 63 open or close the exhaust valves 53, and fluid communication between the combustion chamber 25 and the exhaust ports 51 is allowed or interrupted.

An intake cam sprocket 64 and an intake-side rotation phase controller 65 are provided at one end portion of the intake camshaft 60. The intake-side rotation phase controller 65 rotates the intake camshaft 60 with respect to the intake cam sprocket 64.

When the intake-side rotation phase controller 65 is controlled by the EG-ECU 8, the intake-side rotation phase controller 65 rotates the intake camshaft 60 to advance or retard with respect to the intake cam sprocket 64.

An exhaust cam sprocket 66 and an exhaust-side rotation phase controller 67 are provided at one end portion of the exhaust camshaft 61. The exhaust-side rotation phase controller 67 rotates the exhaust camshaft 61 with respect to the exhaust earn sprocket 66.

When the exhaust-side rotation phase controller 67 is controlled by the EG-ECU 8, the exhaust-side rotation phase controller 67 rotates the exhaust camshaft 61 to advance or retard with respect to the exhaust cam sprocket 66.

A crank sprocket 68 is provided at one end portion of the crankshaft 10. A timing belt 69 is wound around the intake cam sprocket 64, the exhaust cam sprocket 66 and the crank sprocket 68. The timing belt 69 transmits the rotation of the crank sprocket 68 to the intake cam sprocket 64 and the exhaust cam sprocket 66.

Thus, as the rotation of the crankshaft 10 is transmitted to the intake camshaft 60 and the exhaust camshaft 61 by the timing belt 69, the intake valves 52 and the exhaust valves 53 are respectively driven by the intake camshaft 60 and the exhaust camshaft 61, and the intake valves 52 and the exhaust valves 53 open or close the corresponding intake ports 50 and exhaust ports 51 in synchronization with the crankshaft 10. The intake camshaft 60 and the exhaust camshaft 61 rotate one revolution while the crankshaft 10 rotates two revolutions.

A crank rotor 70 is provided on the crankshaft 10. The crank rotor 70 rotates together with the crankshaft 10. The engine 2 includes a crank angle sensor 71 that is used to detect the rotation angle of the crank rotor 70.

The crank angle sensor 71 is formed of an MRE sensor having a magnetic resistance element (MRE). As the crankshaft 10 rotates, the direction of a magnetic field, that is, a magnetic vector, which is applied to the crank angle sensor 71, varies due to peaks and valleys of teeth provided on the crank rotor 70, so an internal resistance value varies.

The crank angle sensor 71 generates a crank angle signal shaped into a rectangular wave having a high state and a low state by comparing a waveform, which is output after converting a variation in the resistance value to a voltage, with a threshold, and outputs the generated crank angle signal to the EG-ECU 8.

Figure 4:
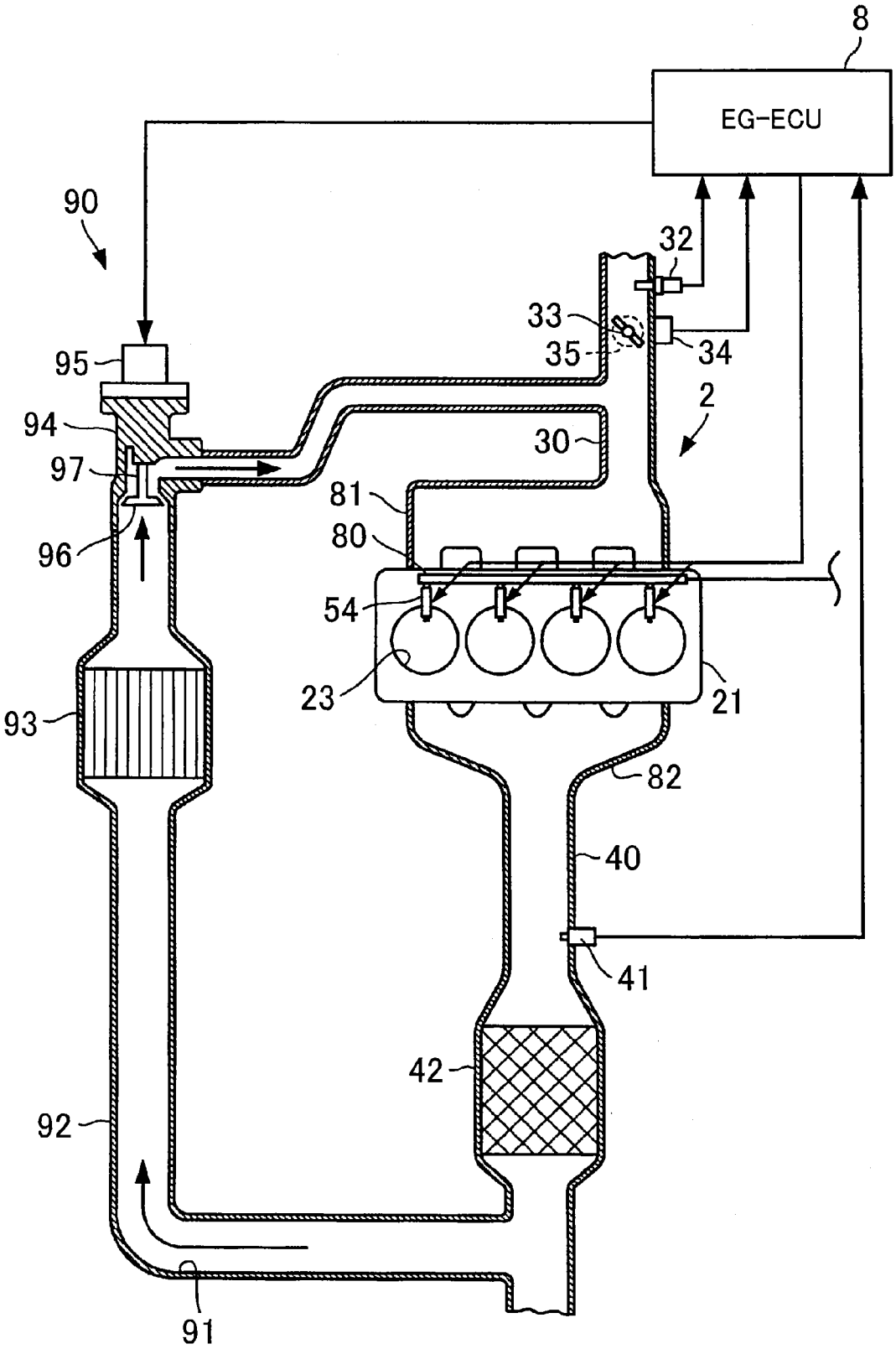
FIG. 4 is a schematic cross-sectional view of the engine shown in FIG. 1, including an EGR device.

As shown in FIG. 4, the engine 2 is provided with a delivery pipe 80, an intake manifold 81 and an exhaust manifold 82. The delivery pipe 80 supplies fuel, introduced from a fuel tank by a supply pump, to the injectors 54 of the cylinders 23 at a predetermined pressure. The intake manifold 81 connects the intake ports 50 of the cylinders 23 to the intake pipe 30. The exhaust manifold 82 connects the exhaust ports 51 of the cylinders 23 to the exhaust pipe 40.

The engine 2 includes an exhaust gas recirculation (EGR) device 90 that is used to recirculate part of exhaust gas, flowing in the exhaust pipe 40, into the intake pipe 30 and supply the part of exhaust gas to the combustion chambers 25 of the cylinders 23. In this way, by providing the EGR device 90, a combustion temperature in each combustion chamber 25 decreases and, as a result, the amount of emissions of NOx reduces, and a pumping loss reduces and, as a result, fuel economy improves.

The EGR device 90 includes an EGR pipe 92 that connects the intake pipe 30 to the exhaust pipe 40 and in which an EGR passage 91 is formed. An EGR cooler 93 and an EGR valve 94 are provided in the EGR pipe 92. The EGR cooler 93 is used to cool exhaust gas that flows through the EGR passage 91 (hereinafter, simply referred to as "EGR gas").

The EGR valve 94 includes a linear solenoid 95 and a shaft 97. The proximal end portion of the shaft 97 is inserted in the linear solenoid 95, and a valve element 96 that opens or closes the EGR passage 91 is provided at the distal end portion of the shaft 97.

When energization of the linear solenoid 95 is controlled by the EG-ECU 8, the linear solenoid 95 reciprocally actuates the shaft 97 in its axial direction by electromagnetic force generated through energization and the repulsive force of a spring (not shown), and opens or closes the EGR passage 91 with the use of the valve element 96.

In the present embodiment, the EGR valve 94 is formed of a normally closed valve that is in an open state when the linear solenoid 95 is energized and that is in a closed state when the linear solenoid 95 is not energized.

In this way, the linear solenoid 95 is controlled by the EG-ECU 8. By so doing, the opening degree of the EGR valve 94 is adjusted, and the amount of EGR gas that is introduced into the intake manifold 81 is adjusted.

In the EGR cooler 93, a refrigerant chamber is formed on an outer peripheral portion of an EGR gas passage. EGR gas supplied from the EGR pipe 92 is cooled through heat exchange with coolant that flows through the refrigerant chamber when the EGR gas passes through the EGR gas passage, and is introduced toward a downstream side.

As shown in FIG. 1, the power transmission device 6 includes motor generators MG1 and MG2 and a power split mechanism 9. The motor generators MG1 and MG2 convert electric power and torque to each other. The power split mechanism 9 splits power generated by the engine 2 into power that is transmitted to the drive wheels 5R and 5L and power that drives the motor generator MG1.

The power split mechanism 9 is formed of a planetary gear mechanism that is connected to an end portion of the crankshaft 10 serving as an output shaft of the engine 2, that splits the power generated by the engine 2 and that integrates power transmitted from the motor generator MG1 and power transmitted from the drive wheels 5R and 5L.

Thus, the power split mechanism 9 causes the motor generator MG1 to function as a generator using one of the split powers, and causes the drive wheels 5R and 5L to rotate using the other one of the split powers.

When the motor generator MG1 functions as an electric motor and the engine 2 is driven, the power split mechanism 9 integrates power input from the engine 2 with power input from the motor generator MG1.

When the motor generator MG1 functions as an electric motor and the engine 2 is stopped, the power split mechanism 9 causes the crankshaft 10 to rotate using power input from the motor generator MG1 and starts the engine 2.

Power output from the power transmission device 6 is transmitted to a differential gear 11. The differential gear 11 is connected to the drive shafts 4R and 4L, and transmits the transmitted power to the drive wheels 5R and 5L via the drive shafts 4R and 4L.

The motor generator MG2 supplied with driving electric power functions as a driving source. Power generated by the motor generator MG2 is transmitted to the drive wheels 5R and 5L.

The motor generator MG2 that is not supplied with driving electric power functions as an electric power regenerator that converts torque to electric power while reducing the speed of rotation of the drive wheels 5R and 5L.

The motor generator MG1 and the motor generator MG2 respectively exchange electric power with a battery 14 via an inverter 12 and an inverter 13, and charge or discharge the battery 14.

In order to execute drive control over the motor generators MG1 and MG2, the hybrid vehicle 1 includes a motor electronic control unit (hereinafter, referred to as "MG-ECU") 15.

The MG-ECU 15 is formed of a microprocessor that includes a central processing unit (CPU), a read only memory (ROM), a random access memory (RAM), a flash memory, and input/output ports.

A program for causing the microprocessor to function as the MG-ECU 15 is stored in the ROM of the MG-ECU 15. That is, as the CPU of the MG-ECU 15 executes the program stored in the ROM using the RAM as a work area, the microprocessor functions as the MG-ECU 15.

The MG-ECU 15 executes drive control over the motor generators MG1 and MG2 by outputting switching control signals to the inverter 12 and the inverter 13.

The MG-ECU 15 communicates with another ECU, such as the HV-ECU 7, via an in-vehicle network, such as a high-speed controller area network (CAN). For example, the MG-ECU 15 executes drive control over the motor generators MG1 and MG2 by controlling the inverters 12 and 13, respectively, in response to control signals input from the HV-ECU 7. The MG-ECU 15, where necessary, outputs data relating to driving states of the motor generators MG1 and MG2 to the HV-ECU 7.

The hybrid vehicle 1 includes a battery electronic control unit (hereinafter, referred to as "B-ECU") 16. The B-ECU 16 is formed of a microprocessor that includes a CPU, a ROM, a RAM, a flash memory and input/output ports.

A program for causing the microprocessor to function as the B-ECU 16 is stored in the ROM of the B-ECU 16. That is, as the CPU of the B-ECU 16 executes the program stored in the ROM using the RAM as a work area, the microprocessor functions as the B-ECU 16.

Signals required to manage the state of the battery 14 are input to the B-ECU 16. The signals, for example, indicate a terminal voltage between the terminals of the battery 14, a charge/discharge current of the battery 14, a temperature of the battery 14, and the like.

The B-ECU 16 communicates with another ECU, such as the HV-ECU 7, via the high-speed CAN. For example, the B-ECU 16, where necessary, outputs data relating to the state of the battery 14 to the HV-ECU 7.

The B-ECU 16 calculates a state of charge (SOC) that indicates a remaining level of the battery 14 on the basis of an accumulated value of the charge/discharge current of the battery 14, and outputs the calculated SOC to the HV-ECU 7.

The HV-ECU 7 is formed of a microprocessor that includes a CPU, a ROM, a RAM, a flash memory and input/output ports. A program for causing the microprocessor to function as the HV-ECU 7 is stored in the ROM. That is, as the CPU executes the program stored in the ROM using the RAM as a work area, the microprocessor functions as the HV-ECU 7.

The HV-ECU 7 communicates with another ECU, such as the EG-ECU 8, via the high-speed CAN. For example, the HV-ECU 7 transmits a control signal that indicates whether to charge the battery 14 with electric power generated by the motor generators MG1 and MG2 to the MG-ECU 15 on the basis of the SOC indicated by data transmitted from the B-ECU 16.

The EG-ECU 8 is formed of a microprocessor that includes a CPU, a ROM, a RAM, a flash memory and input/output ports. A program for causing the microprocessor to function as the EG-ECU 8 is stored in the ROM of the EG-ECU 8.

That is, as the CPU of the EG-ECU 8 executes the program stored in the ROM using the RAM as a work area, the microprocessor functions as the EG-ECU 8.

The EG-ECU 8 communicates with another ECU, such as the HV-ECU 7, via the high-speed CAN. For example, the EG-ECU 8 executes operation control over the engine 2, such as fuel injection control, ignition control and intake air amount adjustment control, on the basis of a control signal that is input from the HV-ECU 7, detection signals that are input from various sensors that detect the operating states of the engine 2, and the like, and, where necessary, outputs data relating to the operating states of the engine 2 to the HV-ECU 7.

The EG-ECU 8 executes variable valve timing (VVT) control for controlling the intake-side rotation phase controller 65 and the exhaust-side rotation phase controller 67 in order to adjust the open/close timing of each intake valve 52 and each exhaust valve 53 on the basis of the operating states of the engine 2.

The EG-ECU 8 executes EGR control for adjusting the amount of EGR gas that is introduced into the intake manifold 81 by adjusting the opening degree of the EGR valve 94 on the basis of the operating states of the engine 2.

In the present embodiment, the EG-ECU 8 normalizes a variation per unit time in air-fuel ratio (hereinafter, simply referred to as "air-fuel ratio variation") with an empirically predetermined constant in correspondence with the rotation speed and load factor of the engine 2.

Specifically, the EG-ECU 8 calculates the rotation speed Ne of the engine 2 from the crank angle signal output from the crank angle sensor 71. The EG-ECU 8 calculates the load factor KL (=Ga/Ne) of the engine 2 on the basis of the intake air amount Ga indicated by the detection signal output from the air flow sensor 32.

A map that associates the rotation speed Ne and load factor KL of the engine 2 and the empirically predetermined constant C for the rotation speed Ne and load factor KL of the engine 2 is stored in advance in the ROM of the EG-ECU 8.

In the following description, a region defined by the rotation speed Ne and load factor KL of the engine 2, shown in the map, is termed "detection region". The detection region is desirably allocated to a region in which the frequency of use by the hybrid vehicle 1 is relatively high and the intake air amount Ga (=Ne×KL) is relatively high.

The EG-ECU 8 calculates an air-fuel ratio variation ΔAF on the basis of the air-fuel ratio AF indicated by the detection signal output from the air-fuel ratio sensor 41 on the condition that the rotation speed Ne and load factor KL of the engine 2 fall within the detection region.

The EG-ECU 8 obtains a minimum value ΔAFmin of the air-fuel ratio variation ΔAF while the engine 2 operates one cycle, that is, the crankshaft 10 rotates two revolutions (720° CA).

Figure 5:
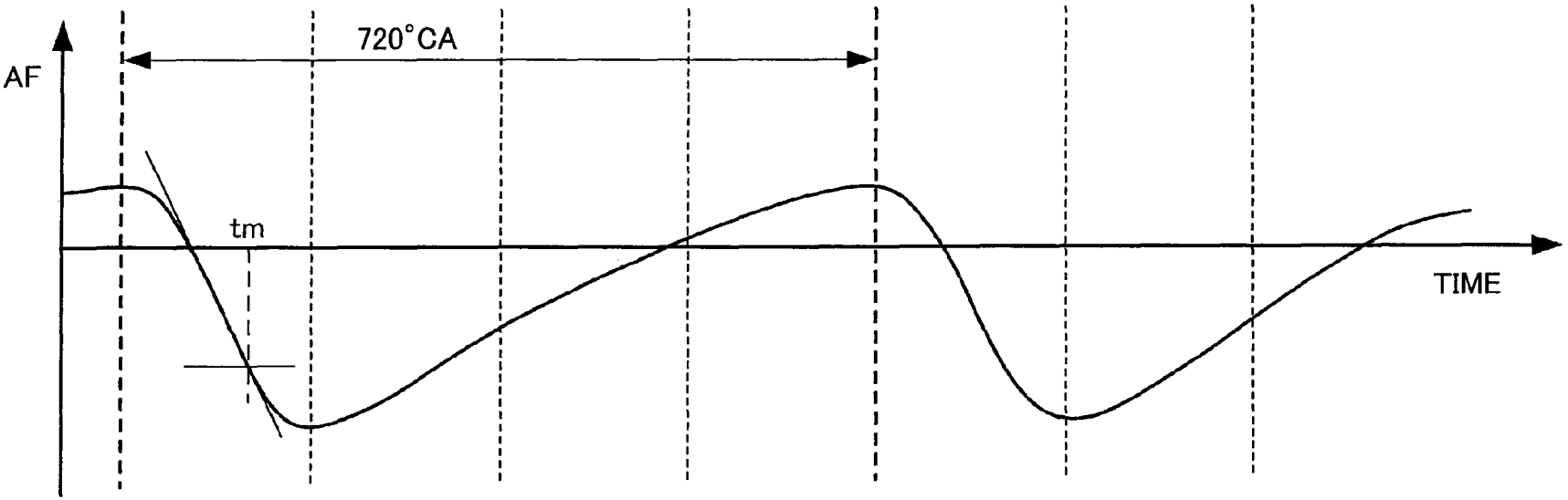
FIG. 5 is a graph that shows the correlation between an air-fuel ratio and time when there is an imbalance in air-fuel ratio among cylinders of the engine shown in FIG. 1.

For example, when the air-fuel ratio AF indicated by the detection signal output from the air-fuel ratio sensor 41 varies as shown in FIG. 5, the air-fuel ratio AF is reduced the most at time tm during 720° CA, so the EG-ECU 8 sets a derivative value of the air-fuel ratio AF, that is, the air-fuel ratio variation ΔAF, at time tm as the minimum value ΔAFmin.

The EG-ECU 8 normalizes the minimum value ΔAFmin with the constant C associated with the rotation speed Ne and load factor KL of the engine 2 using the map stored in the ROM.

The EG-ECU 8 obtains a normalized value ΔAFn by averaging a predetermined number of samples N of (for example, 100) normalized minimum values ΔAFmin.

Therefore, the EG-ECU 8 stores a number of samples N of the normalized minimum values ΔAFmin in the flash memory. As described above, the EG-ECU 8 executes normalization.

The EG-ECU 8 detects a rich imbalance in air-fuel ratio AF among the cylinders 23 on the condition that the normalized value ΔAFn is smaller than a predetermined threshold TH.

Here, the rich imbalance means a state where the air-fuel ratio AF of at least one of the plurality of cylinders 23 is lower than the air-fuel ratio AF of each of the other cylinders 23. As described above, the EG-ECU 8 is configured to detect a rich imbalance.

Figure 6:
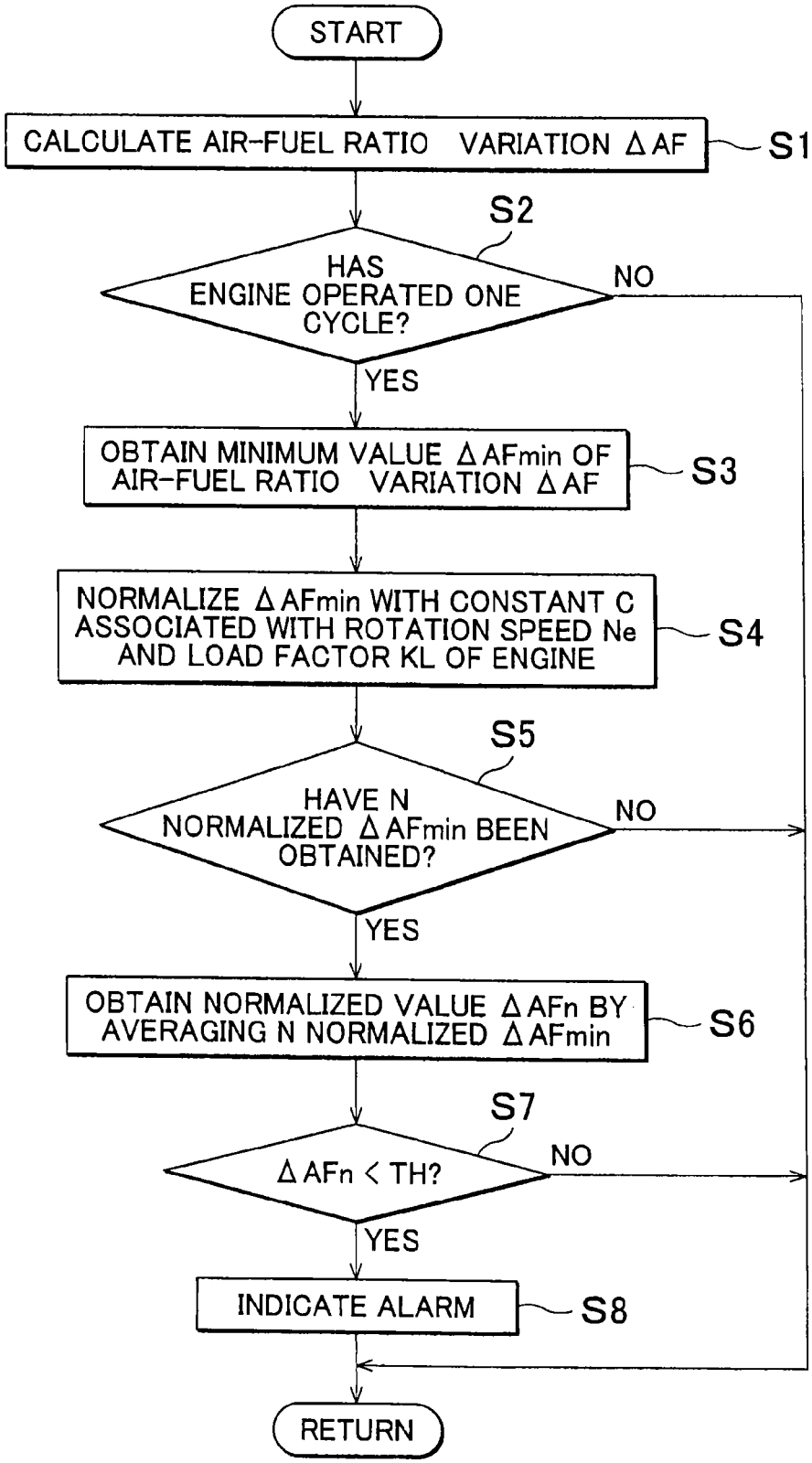
FIG. 6 is a flowchart that shows a rich imbalance detecting operation that is executed by an engine electronic control unit that constitutes the air-fuel ratio imbalance detecting device for an internal combustion engine according to the embodiment of the invention.

Rich imbalance detecting operation that is executed by the EG-ECU 8 in the thus configured hybrid vehicle 1 will be described with reference to FIG. 6. The rich imbalance detecting operation that will be described below is repeatedly executed at predetermined time intervals while the rotation speed Ne and load factor KL of the engine 2 fall within the detection region.

First, the EG-ECU 8 calculates the air-fuel ratio variation ΔAF on the basis of the air-fuel ratio AF indicated by the detection signal output from the air-fuel ratio sensor 41 (step S1). Subsequently, the EG-ECU 8 determines whether the engine 2 has operated one cycle (step S2).

When it is determined that the engine 2 has not operated one cycle, the EG-ECU 8 ends the rich imbalance detecting operation. On the other hand, when it is determined that the engine 2 has operated one cycle, the EG-ECU 8 obtains the minimum value ΔAFmin of the air-fuel ratio variation ΔAF while the engine 2 operates one cycle (step S3).

Subsequently, the EG-ECU 8 normalizes the minimum value ΔAFmin with the constant C associated with the rotation speed Ne and load factor KL of the engine 2 (step S4). Then, the EG-ECU 8 determines whether N normalized minimum values ΔAFmin have been obtained (step S5).

When it is determined that N normalized minimum values ΔAFmin have not been obtained, the EG-ECU 8 ends the rich imbalance detecting operation. On the other hand, when it is determined that N normalized minimum values ΔAFmin have been obtained, the EG-ECU 8 obtains a normalized value ΔAFn by averaging a number of samples N of the normalized minimum values ΔAFmin (step S6).

Subsequently, the EG-ECU 8 determines whether the normalized value ΔAFn is smaller than the threshold TH (step S7). When it is determined that the normalized value ΔAFn is smaller than the threshold TH, the EG-ECU 8 determines that the rich imbalance in air-fuel ratio AF has been detected among the cylinders 23, and, for example, an alarm that indicates that the rich imbalance in air-fuel ratio AF has been detected among the cylinders 23 is indicated on a multi-information display, or the like (step S8), after which the rich imbalance detecting operation is ended.

On the other hand, when it is determined that the normalized value ΔAFn is not smaller than the threshold TH, the EG-ECU 8 determines that the rich imbalance in air-fuel ratio AF has not been detected among the cylinders 23, and then the rich imbalance detecting operation is ended.

The operation of the air-fuel ratio imbalance detecting device for an internal combustion engine according to the above-described embodiment of the invention will be described with reference to FIG. 7.

Figure 7:
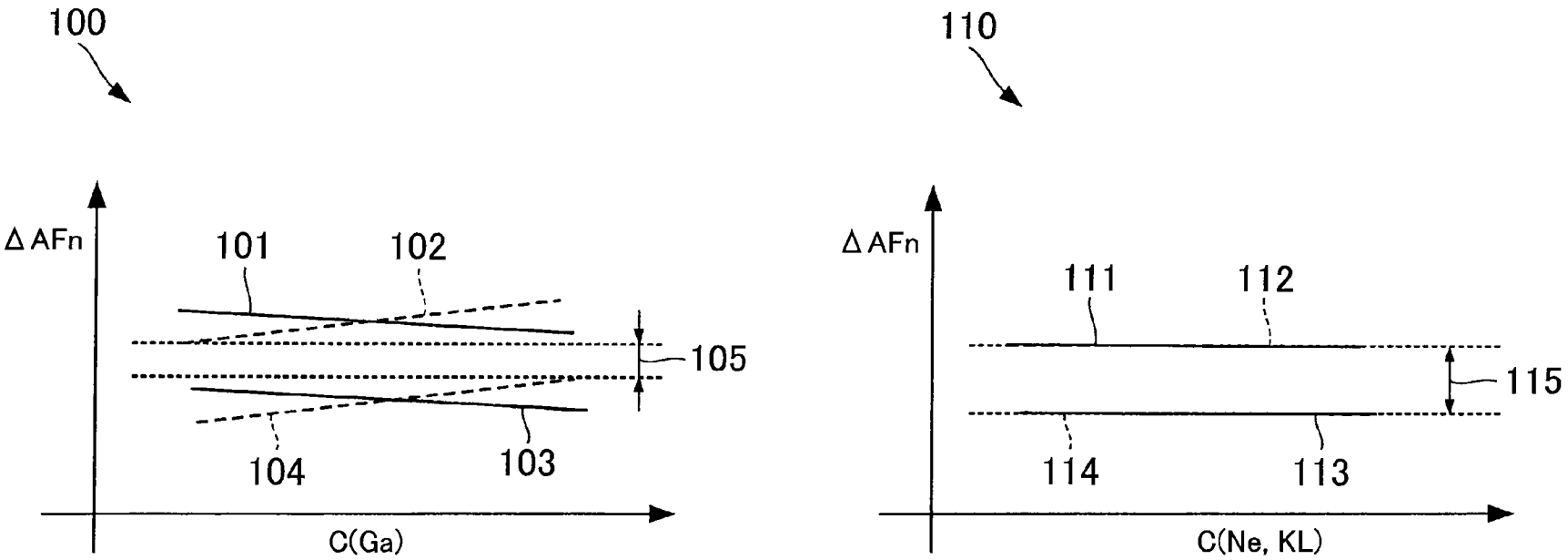
FIG. 7 is a graph for illustrating the operation of the air-fuel ratio imbalance detecting device for an internal combustion engine according to the embodiment of the invention.

In FIG. 7, as indicated by the reference numeral 100, the characteristic of the normalized value ΔAFn that is obtained by normalizing the minimum value ΔAFmin of the air-fuel ratio variation ΔAF with a constant C(Ga) associated with the intake air amount Ga of the engine 2 is the one indicated by the reference numeral 101 for a first load factor KL1 and the one indicated by the reference numeral 102 for a second load factor KL2 in the case where there is a rich imbalance in air-fuel ratio among the cylinders 23.

On the other hand, the characteristic of the normalized value ΔAFn that is obtained by normalizing the minimum value ΔAFmin of the air-fuel ratio variation ΔAF with the constant C(Ga) associated with the intake air amount Ga of the engine 2 is the one indicated by the reference numeral 103 for the first load factor KL1 and the one indicated by the reference numeral 104 for the second load factor KL2 in the case where there is no rich imbalance in air-fuel ratio among the cylinders 23.

In contrast to this, as indicated by the reference numeral 110, the characteristic of the normalized value ΔAFn that is obtained by normalizing the minimum value ΔAFmin of the air-fuel ratio variation ΔAF with a constant C(Ne, KL) associated with the rotation speed Ne and load factor KL of the engine 2 is the one indicated by the reference numeral 111 for the first load factor KL1 and the one indicated by the reference numeral 112 for the second load factor KL2 in the case where there is a rich imbalance in air-fuel ratio among the cylinders 23.

On the other hand, the characteristic of the normalized value ΔAFn that is obtained by normalizing the minimum value ΔAFmin of the air-fuel ratio variation ΔAF with the constant C(Ne, KL) associated with the rotation speed Ne and load factor KL of the engine 2 is the one indicated by the reference numeral 113 for the first load factor KL1 and the one indicated by the reference numeral 114 for the second load factor KL2 in the case where there is no rich imbalance in air-fuel ratio among the cylinders 23.

In this way, a range 115 in which the threshold TH is allowed to be set in the case where the minimum value ΔAFmin of the air-fuel ratio variation ΔAF is normalized with the constant C(Ne, KL) associated with the rotation speed Ne and load factor KL of the engine 2 is wider than a range 105 in which the threshold TH is allowed to be set in the case where the minimum value ΔAFmin of the air-fuel ratio variation ΔAF is normalized with the constant C(Ga) associated with the intake air amount Ga of the engine 2.

In other words, it is possible to set the threshold TH in the case where the minimum value ΔAFmin of the air-fuel ratio variation ΔAF is normalized with the constant C(Ne, KL) associated with the rotation speed Ne and load factor KL of the engine 2 with more allowance than the threshold TH in the case where the minimum value ΔAFmin of the air-fuel ratio variation ΔAF is normalized with the constant C(Ga) associated with the intake air amount Ga of the engine 2.

Thus, the air-fuel ratio imbalance detecting device for an internal combustion engine according to the embodiment of the invention detects a rich imbalance in air-fuel ratio AF among the cylinders 23 on the basis of the normalized value ΔAFn that incorporates a difference in the load factor KL at the same intake air amount Ga by normalizing a variation per unit time in air-fuel ratio AF with a constant associated with the rotation speed Ne and load factor KL of the engine 2, so it is possible to accurately detect an imbalance in air-fuel ratio AF among the cylinders 23 of the internal combustion engine.

When the minimum value ΔAFmin of the air-fuel ratio variation ΔAF is normalized with the constant C(Ga) associated with the intake air amount Ga of the engine 2, the air-fuel ratio AF significantly varies due to the influence of VVT control and EGR control, so, for example, a singular point occurs in FIG. 7.

In contrast to this, the air-fuel ratio imbalance detecting device for an internal combustion engine according to the embodiment of the invention makes setting by incorporating influence due to VVT control and EGR control into the constant C(Ne, KL) associated with the rotation speed Ne and load factor KL of the engine 2. By so doing, it is possible to prevent occurrence of the above-described singular point, so it is possible to prevent erroneous detection of a rich imbalance in air-fuel ratio AF among the cylinders 23 of the engine 2.

In the present embodiment, the description is made on the example in which the air-fuel ratio imbalance detecting device for an internal combustion engine according to the invention is applied to the power split-type hybrid vehicle. Instead of the hybrid vehicle, a vehicle control device according to the invention may be applied to a hybrid vehicle of another type, such as a parallel type, or another vehicle, such as a fuel-cell vehicle, an electric vehicle, a gasoline engine vehicle and a diesel engine vehicle.

The embodiment described above is illustrative and not restrictive in all respects. The scope of the invention is defined by the appended claims rather than the above description. The scope of the invention is intended to encompass all modifications within the scope of the appended claims and equivalents thereof.

As described above, the air-fuel ratio imbalance detecting device for an internal combustion engine according to the invention is advantageously able to accurately detect an imbalance in air-fuel ratio among the cylinders of the internal combustion engine, and is useful in the air-fuel ratio imbalance detecting device that detects a rich imbalance in air-fuel ratio among the cylinders of the internal combustion engine.

What is claimed is:

1. An air-fuel ratio imbalance detecting device for an internal combustion engine, which detects a rich imbalance in air-fuel ratio among a plurality of cylinders on the basis of a variation per unit time in air-fuel ratio that is detected by an air-fuel ratio sensor provided in an exhaust passage of the internal combustion engine, the device comprising:

an electronic control unit configured to obtain a rotation speed of the internal combustion engine;

calculate a load factor of the internal combustion engine based on an intake air amount detected by an air flow sensor;

obtain the variation per unit time in air-fuel ratio;

obtain a minimum value of the variation per unit time in air-fuel ratio while the internal combustion engine operates one cycle;

determine a constant using a predetermined map based on the obtained rotation speed and the calculated load factor;

normalize the minimum value of the variation per unit time in air-fuel ratio with the determined constant to obtain a normalized minimum value of the variation per unit time in air-fuel ratio;

compare the normalized minimum value of the variation per unit time in air-fuel ratio with a predetermined threshold; and determine that there is a rich imbalance in air-fuel ratio among the cylinders when the normalized minimum value of the variation per unit time in air-fuel ratio is smaller than the predetermined threshold.

2. The air-fuel ratio imbalance detecting device according to claim 1, wherein the electronic control unit is configured to obtain the normalized minimum value of the variation per unit time in air-fuel ratio by averaging a predetermined number of normalized minimum values of the variation per unit time in air-fuel ratio.

3. The air-fuel ratio imbalance detecting device according to claim 1, wherein the electronic control unit is configured to obtain the variation per unit time in air-fuel ratio when the obtained rotation speed and the calculated load factor are within a predetermined detection region.

4. An air-fuel ratio imbalance detecting method for an internal combustion engine, which detects a rich imbalance in air-fuel ratio among a plurality of cylinders on the basis of a variation per unit time in air-fuel ratio that is detected by an air-fuel ratio sensor provided in an exhaust passage of the internal combustion engine, the method comprising:

calculating a load factor of the internal combustion engine based on an intake air amount detected by an air flow sensor;

obtaining the variation per unit time in air-fuel ratio;

obtaining a minimum value of the variation per unit time in air-fuel ratio while the internal combustion engine operates one cycle;

determining a constant using a predetermined map based on a rotation speed and the calculated load factor;

normalizing the minimum value of the variation per unit time in air-fuel ratio with the determined constant to obtain a normalized minimum value of the variation per unit time in air-fuel ratio;

comparing the normalized minimum value of the variation per unit time in air-fuel ration with a predetermined threshold; and determining that there is a rich imbalance in air-fuel ratio among the cylinders when the normalized minimum value of the variation per unit time in air-fuel ratio is smaller than the predetermined threshold.

5. The air-fuel ratio imbalance detecting method according to claim 4, wherein the normalized minimum value of the variation per unit time in air-fuel ratio is obtained by averaging a predetermined number of normalized minimum values of the variation per unit time in air-fuel ratio.

6. The air-fuel ratio imbalance detecting method according to claim 4, wherein the variation per unit time in air-fuel ratio is obtained when the rotation speed and the calculated load factor are within a predetermined detection region.

* * * * *